US009789598B2

(12) United States Patent
Ontl et al.

(10) Patent No.: US 9,789,598 B2
(45) Date of Patent: Oct. 17, 2017

(54) HANDHELD POWER TOOL

(75) Inventors: Rainer Ontl, Landsberg (DE); Christoph Dieing, Isny im Allgaeu (DE); Christian Rehekampff, Kaufering (DE); Damir Cehajic, Durach (DE)

(73) Assignee: Hilti Aktiengesellschaft, Schaan (LI)

( * ) Notice: Subject to any disclaimer, the term of this patent is extended or adjusted under 35 U.S.C. 154(b) by 532 days.

(21) Appl. No.: 13/594,655

(22) Filed: Aug. 24, 2012

(65) Prior Publication Data

US 2013/0220658 A1 Aug. 29, 2013

(30) Foreign Application Priority Data

Aug. 26, 2011 (DE) ..... 10 2011 081 617

(51) Int. Cl.

| | |
|---|---|
| ***B25D 17/11*** | (2006.01) |
| ***B25D 17/24*** | (2006.01) |
| ***B25D 17/00*** | (2006.01) |
| ***B25D 16/00*** | (2006.01) |

(52) U.S. Cl.

CPC ..... *B25D 17/24* (2013.01); *B25D 16/003* (2013.01); *B25D 2250/121* (2013.01); *B25D 2250/131* (2013.01); *B25D 2250/165* (2013.01); *B25D 2250/245* (2013.01); *B25D 2250/331* (2013.01)

(58) Field of Classification Search

CPC ... B25B 17/02; B25B 21/004; B25B 23/1422; B25D 17/24

USPC ..... 173/211, 90

See application file for complete search history.

(56) References Cited

U.S. PATENT DOCUMENTS

| | | | | |
|---|---|---|---|---|
| 3,874,460 | A * | 4/1975 | Schmid et al. | 173/109 |
| 4,191,264 | A * | 3/1980 | Antipov | B25B 21/026 173/93.6 |
| 4,229,981 | A * | 10/1980 | Macky | B25D 16/003 173/48 |
| 4,285,422 | A * | 8/1981 | Bentley | 192/105 B |
| 5,111,890 | A | 5/1992 | Ranger et al. | |
| 5,366,412 | A * | 11/1994 | Beaty | A61C 8/0089 433/173 |

(Continued)

FOREIGN PATENT DOCUMENTS

| | | |
|---|---|---|
| DE | 199 33 972 A1 | 1/2001 |
| DE | 10 2004 047 470 A1 | 4/2006 |

(Continued)

OTHER PUBLICATIONS

European Search Report, dated Nov. 23, 2012, 6 pages.
German Search Report, dated Jul. 6, 2012, 4 pages.

*Primary Examiner* — Robert Long
(74) *Attorney, Agent, or Firm* — Crowell & Moring LLP

(57) ABSTRACT

A handheld power tool is disclosed. The tool has a housing, a hammer mechanism and a torque coupling. The hammer mechanism includes a beater which is movably guided along the working axis in the guide tube. The guide tube is mounted in a suspension attached to the housing so that it is movable along the working axis. The torque coupling is mounted on the guide tube and is supported on the suspension in the impact direction. The guide tube is supported on the torque coupling in the impact direction. The guide tube may be shifted with respect to the housing in the impact direction such that the torque coupling is shifted relative to the housing through the guide tube in a positively guided manner.

5 Claims, 1 Drawing Sheet

(56) References Cited

U.S. PATENT DOCUMENTS 5,373,905 A * 12/1994 Bleicher et al. ..... 173/109
5,538,089 A * 7/1996 Sanford ..... B25B 23/141 173/13
5,588,496 A * 12/1996 Elger ..... B25B 23/1405 173/178
5,954,140 A * 9/1999 Bauer ..... 173/48
6,902,012 B2 * 6/2005 Kristen ..... B25D 11/125 173/128
8,459,658 B2 * 6/2013 Cycon ..... 279/19.6
2004/0134673 A1 * 7/2004 Droste ..... B25D 16/003 173/178
2004/0211574 A1 * 10/2004 Droste ..... B25D 16/00 173/29
2004/0245005 A1 * 12/2004 Toyama ..... B25D 16/003 173/48
2006/0054333 A1 * 3/2006 Duesselberg ..... B25D 16/003 173/201
2006/0076154 A1 * 4/2006 Aoki ..... 173/212
2007/0056756 A1 * 3/2007 Chung ..... B25B 21/02 173/48
2007/0289759 A1 * 12/2007 Hartmann et al. ..... 173/48
2008/0308287 A1 * 12/2008 Sugiyama ..... B25D 11/125 173/211
2009/0025949 A1 * 1/2009 Aoki ..... B23D 51/16 173/162.1
2010/0108340 A1 * 5/2010 Peippo ..... B25D 11/12 173/120
2010/0326685 A1 * 12/2010 Roehm ..... B25D 16/00 173/46
2012/0125650 A1 * 5/2012 Koch ..... B25D 17/24 173/211
2015/0014005 A1 * 1/2015 Puzio ..... B25B 21/02 173/2

FOREIGN PATENT DOCUMENTS

EP 1 157 788 A2 11/2001
EP 2 314 420 A1 4/2011

* cited by examiner

HANDHELD POWER TOOL

This application claims the priority of German Patent Document No. DE 10 2011 081 617.8, filed Aug. 26, 2011, the disclosure of which is expressly incorporated by reference herein.

BACKGROUND AND SUMMARY OF THE INVENTION

The present invention relates to a handheld power tool having a hammer mechanism, preferably a pneumatic hammer mechanism, e.g., a jackhammer. With a beater of the hammer mechanism, the jackhammer strikes a cutter to drive it into a substrate. The momentum of the beater is transferred efficiently to the cutter. However, if the cutter is not in contact with a workpiece, the result is an empty strike. The beater runs into a front stop and transfers the momentum to the handheld power tool. It is known that the front stop may be provided with damping rings made of an elastomer, for example, to absorb the resulting forces and protect the jackhammer.

The handheld power tool according to the invention has a housing, a hammer mechanism and a torque coupling. The hammer mechanism contains a beater, which is movably guided along a working axis. The guide tube is mounted in a suspension attached to the housing so that the guide tube is movable along the working axis. The torque coupling is mounted on the guide tube and supported on the suspension in the impact direction. The guide tube is supported on the torque coupling in the impact direction. The guide tube may be displaced with respect to the housing in the impact direction, such that the torque coupling is shifted by the guide tube in a positively guided movement in relation to the housing.

The momentum transferred to the guide tube in the blank impact is introduced into the housing via the torque coupling. The torque coupling acts as a delay element. The torque coupling expediently has a return spring, which exerts a force on the suspension in the impact direction and exerts a force on the guide tube in the direction opposite the impact direction. The return spring extends the transfer of momentum to the housing and thus also extends the resulting forces.

According to one embodiment, the torque coupling includes, in the direction of impact, a first coupling disk, a second coupling disk and a return spring in this order. The guide tube is supported on the first coupling disk or on the second coupling disk in the impact direction. The return spring acts on the suspension in the impact direction and acts on the second coupling disk in the direction opposite the impact direction. The guide tube can move in the impact direction but only by entraining at least one of the coupling disks. The return spring arranged between the suspension and the coupling disks is compressed in the process. The guide tube may also be engaged between the two coupling disks, thereby raising the first coupling disk from the second coupling disk in restriking. The coupling is thus released briefly in restriking and the transfer of torque is interrupted. Another embodiment extends directly to the return spring to utilize this for damping of the restriking of the blank strike.

One embodiment provides for the suspension to include a first ring rigidly connected to the housing and a second ring extending around the guide tube. The guide tube is axially movable in the second ring, and the second ring is in contact with the first ring in the impact direction. The return spring may be in contact with the second ring.

The following description illustrates the invention on the basis of exemplary embodiments and the FIGURE.

DETAILED DESCRIPTION OF THE DRAWING

Figure 1:
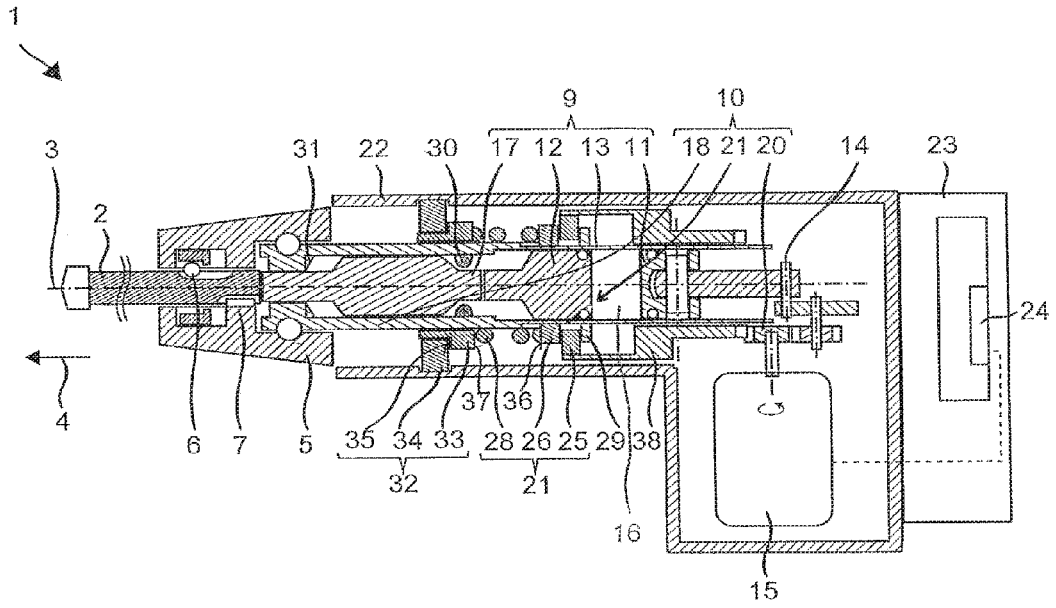
FIG. 1 shows a jackhammer.

FIG. 1 shows a jackhammer 1 as an example of a handheld cutting tool. The jackhammer 1 can drive a boring tool 2 to rotate about a working axis 3 and can advance the boring tool 2 along the working axis 3 in the impact direction 4. An operating mode of the jackhammer 1 allows simultaneous rotation and striking for quarrying rocks, breaking down masonry, etc., with a rotary drill.

A tool receptacle 5 has a locking element 6 which secures the boring tool 2 in the tool receptacle 5 to prevent it from falling out and at the same time permits a limited movement of the boring tool 2 along the working axis 3 in the tool receptacle 5. The locking elements 6 are designed to be complementary to the boring tool 2, for example, in the form of radially displaceable balls here, which can engage in locking grooves closed along the working axis in the boring tool 2. The tool receptacle 5 also inhibits a relative rotational movement of the boring tool 2, for example, by radially protruding, rotationally slaving webs 7, which engage in corresponding open entraining grooves in the boring tool 2.

The tool receptacle 5 supports the boring tool 2 in such a way that a hammer mechanism 9 can strike a rear end face of the boring tool 2. The tool receptacle 5 is also connected to a rotary drive 10 in a rotationally fixed manner to transfer a torque supplied by the rotary drive 10 to the boring tool 2.

The hammer mechanism 9 is a pneumatic hammer mechanism 9. An exciter 11 and a beater 12 are guided movably in a guide tube 13 along the working axis 3. The exciter 11 is connected to a motor 15 via a cam 14 or a wobble finger and is forced into a periodic translatory movement. A pneumatic spring formed by a pneumatic chamber 16 between the exciter 11 and the beater 12 couples a movement of the beater 12 to the movement of the exciter 11. The beater 12 can strike a rear end of the boring tool 2 directly or can transfer a portion of its momentum to the boring tool 2 via an intermediate beater 17 (riveting die) resting essentially in the guide tube 13.

The rotary drive 10 has an output spindle 18, for example, which is detachably or inseparably coupled to the tool receptacle 5 in a rotationally rigid manner. The output spindle 18 may be, for example, a hollow shaft, e.g., the guide tube 13 which engages around the hammer mechanism 9. The output spindle 18 is coupled to the motor 15 via a drivetrain. The drivetrain may include, among other things, a single-stage or multi-stage gear 20 and a torque coupling 21. The torque coupling 21 is designed in particular as an overload protection and interrupts the drivetrain if a torque acting on the boring tool 2 from the motor 15 exceeds a limit value.

The motor 15, the hammer mechanism 9 and the rotary drive 10 are preferably arranged in a machine housing 22. A handle 23 inseparably connected to the machine housing 22 allows the user to hold and guide the jackhammer 1. The motor 15 is activated and the jackhammer 1 is operated in response to operation of one or more operating elements, for example, a system switch 24 on the handle 23. Selector switches allow selective activation of the hammer mechanism 9 and/or the rotary drive 10, for example.

The torque coupling 21, for example, has a first coupling disk 25 and a second coupling disk 26 which are arranged coaxially with the guide tube 13. The first coupling disk 25 meshes with the gear 20 and is loosely mounted on the guide tube 13, so that the first coupling disk 25 can rotate with respect to the guide tube 13. The second coupling disk 26 meshes with the guide tube 13 by gear teeth. The coupling disks 25, 26, for example, have planar end faces which transfer a torque from one to the other via adhesive friction. In other embodiments the first coupling disk 25 or the second coupling disk 26 is provided with cams or other structures meshing with the opposing coupling disk. The second coupling disk 26 can be displaced on the guide tube 13 along the working axis 3 and in relation to the first coupling disk 25. The torque coupling 21 is closed when the two coupling disks 25, 26 come in contact with one another and thus a torque is transferred from the gear 20 to the guide tube 13 and therefore is transferred from the motor 15 to the tool receptacle 5. A return spring 28 acts on the movable second coupling disk 26, shifting it in the direction toward the first coupling disk 25, in this case in the direction opposite the impact direction 4, for example. The torque coupling 21 is closed in its basic position.

The first coupling disk 25 is in contact with a radial protrusion 29 on the guide tube 13 opposite the impact direction 4, the protrusion inhibiting movement of the first coupling disk 25 in the direction opposite the impact direction 4 beyond this protrusion 29. The protrusion 29 may comprise, for example, a ring which is placed on the guide tube 13 and is secured axially on the guide tube 13 by a spring ring.

The guide tube 13 is suspended in the machine housing 22, so that it is displaceable along the working axis 3. On impact of the beater 12 or the riveting die 17 with the stops 30, 31 provided in the impact direction 4, the guide tube 13 can absorb a portion of the kinetic energy.

A suspension 32 of the guide tube 13 on the machine housing 22 comprises an inner ring 33 and an outer ring 34, for example. The inner ring 33 is inserted into the outer ring 34 and is mounted therein so it can rotate about the working axis 3. The bearing may comprise a simple friction bearing or a roller bearing. For the inner ring 33, the outer ring 34 forms a stop face 35, which faces in the direction opposite the impact direction 4. The outer ring 34, for example, does not have a stop face which limits movement of the inner ring 33 in the direction opposite the impact direction 4. The guide tube 13 is inserted into the inner ring 33. The inner ring 33 is axially movable with respect to the guide tube 13. The outer ring 34 is secured on the machine housing 22 so that it is axially immovable. One embodiment not shown here does not provide any separation of the suspension 32 into the rings 33, 34 which are arranged to rotate in relation to one another.

The return spring 28 is supported on the inner ring 33 of the suspension 32 in the impact direction 4. With an axial movement of the guide tube 13 in the impact direction 4, there is an introduction of force via the protrusion 29 into the coupling disks 25, 26 which are movable axially with respect to the machine housing 22 and via the return spring 28 and onto the suspension 32, which is immovable with respect to the machine housing 22 at least in the impact direction 4. The return spring 28 is compressed in the process.

The return spring 28 is in contact with a face 36 of the second coupling disk 26 facing in the impact direction 4 and is in contact with a face 37 of the inner ring 33 facing in the direction opposite the impact direction 4.

If the guide tube 13 is mounted on the machine housing 22 via additional suspensions, all of these allow a relative movement of the guide tube 13 with respect to the machine housing 22 along the working axis 3.

The gear 20 has a hollow wheel 38 with internal teeth. The hollow wheel 38 is arranged coaxially with the first coupling disk 25 and meshes with external teeth on the first coupling disk 25.

According to another embodiment the second disk 26 is in contact with the radial protrusion 29. The radial protrusion 29 is arranged between the two coupling disks 25, 26. There is an introduction of the force of the moving guide tube 13 which omits the first coupling disk 25. The moving guide tube 13 separates the two coupling disks along the working axis 3 and thus opens the torque coupling 21. In this design the first coupling disk 25 may be arranged immovably along the working axis 3 with respect to the machine housing 22.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A handheld power tool, comprising:

a housing;

a hammer mechanism, wherein the hammer mechanism includes a beater guided movably in a guide tube along a working axis;

a suspension which is attached to the housing, wherein the guide tube is mounted in the suspension such that the guide tube is longitudinally movable along the working axis; and a drivetrain including a gear and a torque coupling, wherein the torque coupling is mounted on the guide tube and is supported on the suspension in an impact direction, wherein the guide tube is supported on the torque coupling in the impact direction, wherein the torque coupling transfers a torque from the gear to the guide tube when the torque coupling is closed, wherein the torque coupling is an overload protection and interrupts the drivetrain if a torque acting on a boring tool of the handheld power tool from the gear exceeds a limit value, wherein the torque coupling has a first coupling disk, a second coupling disk, and a return spring, wherein the guide tube is supported on the first or the second coupling disk in the impact direction, and wherein the return spring is disposed between the suspension in the impact direction and the second coupling disk in a direction opposite the impact direction.

2. The handheld power tool according to claim 1, wherein a force is exertable by the return spring on the suspension in the impact direction and wherein a force is exertable by the return spring on the guide tube in a direction opposite the impact direction.

3. The handheld power tool according to claim 2, wherein the suspension comprises a first ring rigidly connected to the housing and a second ring extending around the guide tube and wherein the guide tube is movable in the second ring along the working axis and the second ring is in contact with the first ring in the impact direction.

4. The handheld power tool according to claim 3, wherein the return spring is in contact with the second ring.

5. A handheld power tool, comprising:

a housing;

a guide tube disposed within the housing and longitudinally movable along a working axis and including a projection;

a hammer mechanism movably disposed within the guide tube along the working axis;

a suspension attached to the housing, wherein the guide tube is moveably disposed through the suspension; and a drivetrain including a gear and a torque coupling, wherein the torque coupling is mounted on the guide tube and is disposed between the suspension and the projection, wherein the torque coupling transfers a torque from the gear to the guide tube when the torque coupling is closed, wherein the torque coupling is an overload protection and interrupts the drivetrain if a torque acting on a boring tool of the handheld power tool from the gear exceeds a limit value, wherein the torque coupling has a first coupling disk, a second coupling disk, and a return spring, wherein the guide tube is supported on the first or the second coupling disk in the impact direction, and wherein the return spring is disposed between the suspension in the impact direction and the second coupling disk in a direction opposite the impact direction.

* * * * *